US008552969B2

(12) United States Patent
Huang

(10) Patent No.: US 8,552,969 B2
(45) Date of Patent: Oct. 8, 2013

(54) BACKLIGHT ADJUSTING SYSTEM AND METHOD

(75) Inventor: Shun-Ming Huang, Shenzhen (CN)

(73) Assignees: Innocom Technology (Shenzhen) Co., Ltd., Shenzhen, Guangdong Province (CN); Chimei Innolux Corporation, Miaoli County (TW)

( * ) Notice: Subject to any disclaimer, the term of this patent is extended or adjusted under 35 U.S.C. 154(b) by 751 days.

(21) Appl. No.: 12/720,632

(22) Filed: Mar. 9, 2010

(65) Prior Publication Data

US 2010/0231602 A1 Sep. 16, 2010

(30) Foreign Application Priority Data

Mar. 13, 2009 (CN) ..... 2009 1 0300843

(51) Int. Cl.
*G09G 3/36* (2006.01)

(52) U.S. Cl.
USPC ..... 345/102; 362/97.2

(58) Field of Classification Search
USPC ..... 345/102, 207; 313/498; 362/97.1, 97.2, 362/97.3; 349/69, 70
See application file for complete search history.

(56) References Cited

U.S. PATENT DOCUMENTS

| | | | | |
|---|---|---|---|---|
| 6,078,302 | A * | 6/2000 | Suzuki | 345/77 |
| 8,004,545 | B2 * | 8/2011 | Inuzuka et al. | 345/690 |
| 2002/0030660 | A1 * | 3/2002 | Arakawa | 345/102 |
| 2005/0057484 | A1 * | 3/2005 | Diefenbaugh et al. | 345/102 |
| 2006/0055661 | A1 | 3/2006 | Kawaguchi | |
| 2007/0070024 | A1 | 3/2007 | Araki et al. | |
| 2007/0171182 | A1 * | 7/2007 | Mizuno et al. | 345/102 |
| 2008/0001910 | A1 * | 1/2008 | Lim | 345/102 |
| 2008/0165115 | A1 * | 7/2008 | Herz et al. | 345/102 |
| 2008/0248837 | A1 * | 10/2008 | Kunkel | 455/566 |
| 2008/0259067 | A1 * | 10/2008 | Wang et al. | 345/207 |
| 2009/0015543 | A1 | 1/2009 | Wei et al. | |
| 2009/0104941 | A1 * | 4/2009 | Kwon et al. | 455/566 |
| 2009/0195524 | A1 * | 8/2009 | Shen | 345/207 |
| 2009/0237423 | A1 * | 9/2009 | Shih et al. | 345/690 |

FOREIGN PATENT DOCUMENTS

| | | |
|---|---|---|
| CN | 1607884 A | 4/2005 |
| CN | 1890701 A | 1/2007 |
| CN | 101042841 A | 9/2007 |

(Continued)

OTHER PUBLICATIONS

Taiwan Search Report for Taiwan Application No. 098110337 dated Feb. 26, 2013 with English translation.

*Primary Examiner* — Tom Sheng
(74) *Attorney, Agent, or Firm* — Muncy, Geissler, Olds & Lowe, PLLC

(57) ABSTRACT

A backlight adjusting system and method is adapted for adjusting a backlight brightness of a light emitting element for a display panel based on an ambient light around the display panel. The backlight adjusting system includes a first calculator, a processor and a driver. The first calculator calculates a target display brightness value of the display panel based on an actual ambient brightness value of the ambient light, a predetermined optimal ambient brightness value of the ambient light, and a predetermined optimal display brightness value of the display panel determined according to the predetermined optimal ambient brightness value. The processor obtains a target pulse duty value based on the target display brightness value. The driver generates a driving signal based on the target pulse duty value utilizing pulse width modulation techniques for driving the light emitting element so as to adjust the backlight brightness of the light emitting element.

21 Claims, 5 Drawing Sheets

(56) References Cited

FOREIGN PATENT DOCUMENTS

| | | | |
|---|---|---|---|
| CN | 101145332 A | 3/2008 | |
| TW | 200627335 | 8/2006 | |
| TW | 200634695 | 10/2006 | |
| TW | 200746030 | 12/2007 | |
| TW | 200903435 A | 1/2009 | |

* cited by examiner

BACKLIGHT ADJUSTING SYSTEM AND METHOD

BACKGROUND

1. Technical Field

The present disclosure relates to a backlight adjusting system and a backlight adjusting method, and more particularly to a backlight adjusting system and a backlight adjusting method for adjusting backlight brightness of a light emitting element for a display panel based on an ambient light around the display panel.

2. Description of Related Art

Display quality of a liquid crystal display (LCD) is affected by an ambient light around the LCD. In the LCD, a backlight adjusting system is used to adjust a backlight brightness of a light emitting element for an LCD panel based on the ambient light. Typically, the backlight brightness is adjusted to increase when the ambient brightness of the ambient light is high, and is adjusted to decrease when the ambient brightness is low, so that the display quality can be improved.

Referring to FIG. 1, a conventional backlight adjusting system 1 includes a brightness sensor 11, an analog-to-digital converter 12, a storage media 13, a processor 14 and a driver 15. The brightness sensor 11 is configured to detect ambient brightness and to generate an actual ambient brightness signal accordingly. The analog-to-digital converter 12 is coupled to the brightness sensor 11 and configured to convert the actual ambient brightness signal to an actual ambient brightness value in an analog-to-digital manner. The storage media 13 is configured to store a look-up table which includes a list of predetermined ambient brightness values and a list of predetermined pulse duty values corresponding respectively to the predetermined ambient brightness values. The processor 14 is electrically coupled to the analog-to-digital converter 12 and the storage media 13, and configured to obtain a target pulse duty value from the predetermined pulse duty values by matching the actual ambient brightness value with one of the predetermined ambient brightness values. The driver 15 is electrically coupled to the processor 14, and configured to generate a driving signal based on the target pulse duty value utilizing pulse width modulation techniques for driving the light emitting element so as to adjust the backlight brightness.

The aforesaid backlight adjusting system 1 has some problems. Although the backlight brightness can be adjusted through the look-up table to improve the display quality, the backlight brightness thus obtained is unlikely to achieve an optimal condition, hence, an optimal display quality is also unlikely to be achieved. Furthermore, since the backlight brightness is determined by the use of the aforementioned look-up table, it cannot be adjusted with the variations of the brightness caused by the aging of the light emitting element or by the use of different light emitting elements having different illuminating characteristics.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe various embodiments in detail.

Figure 5:
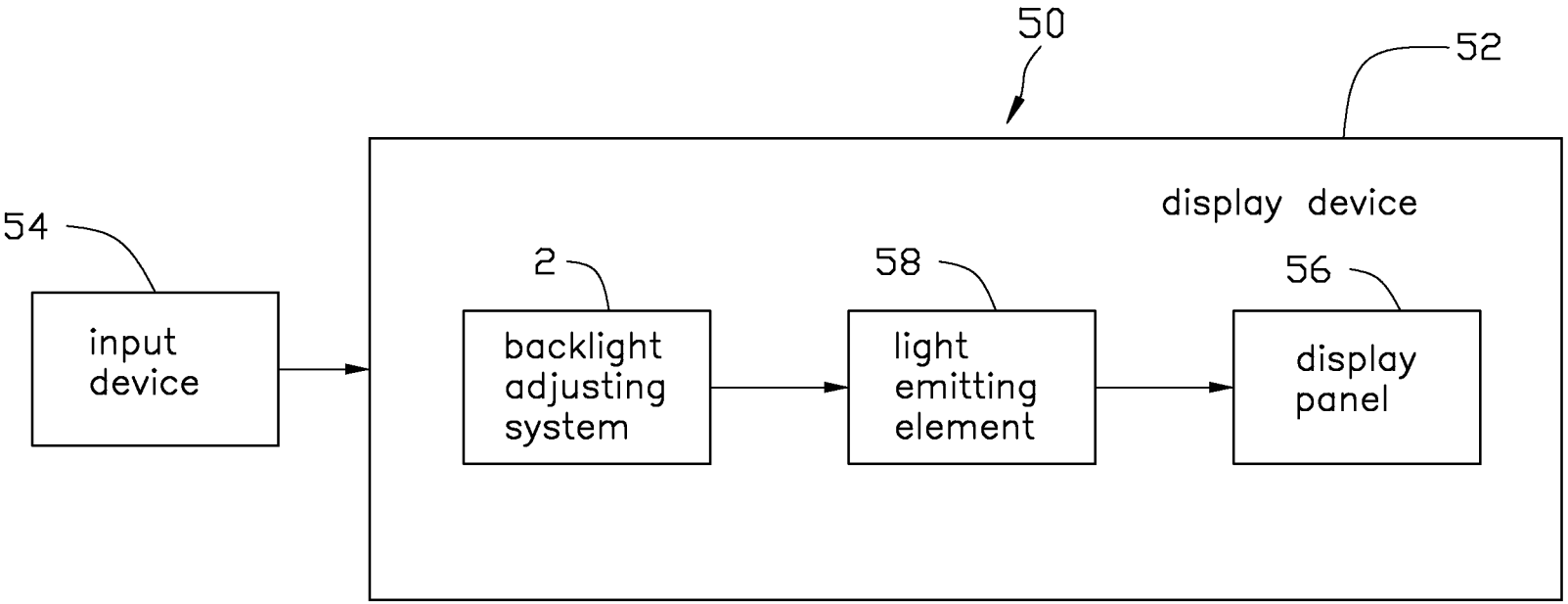
FIG. 5 is a schematic diagram showing one embodiment of an electronic device including a backlight adjusting system.

FIG. 5 is a schematic diagram showing one embodiment of an electronic device 50. As shown in FIG. 5, the electronic device 50 includes a display device 52 and an input device 54 electrically connected to the display device 52. The input device 54 can input data to the display device 52 to render an image. The electronic device 50 can be, for example, a computer, a notebook computer, a mobile telephone, a portable electronic game, a television, or a digital camera, for example.

The display device 52 includes a display panel 56, a light emitting element 58, and a backlight adjusting system 2. The light emitting element 58 is optically coupled to the display panel 56 to emit light to the display panel 56. The backlight adjusting system 2 can adjust a backlight brightness of the light emitting element 58 based on an ambient light around the display panel 56.

Figure 1:
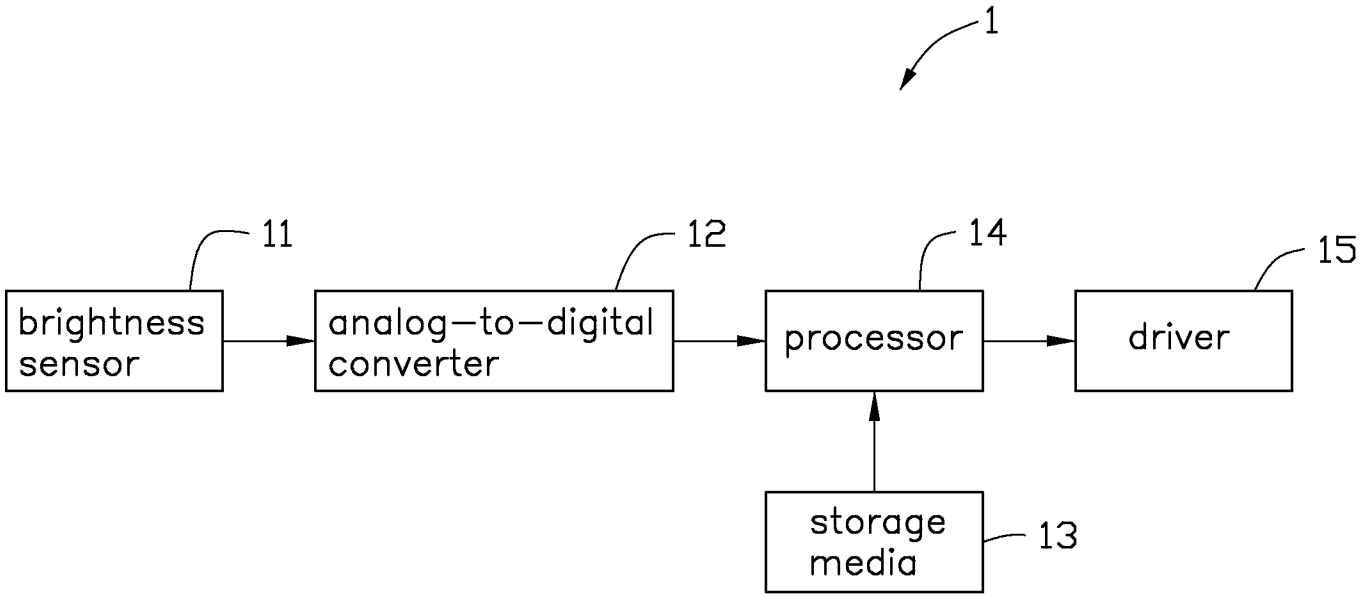
FIG. 1 (PRIOR ART)
FIG. 1 is a block diagram of a conventional backlight adjusting system.
Figure 2:
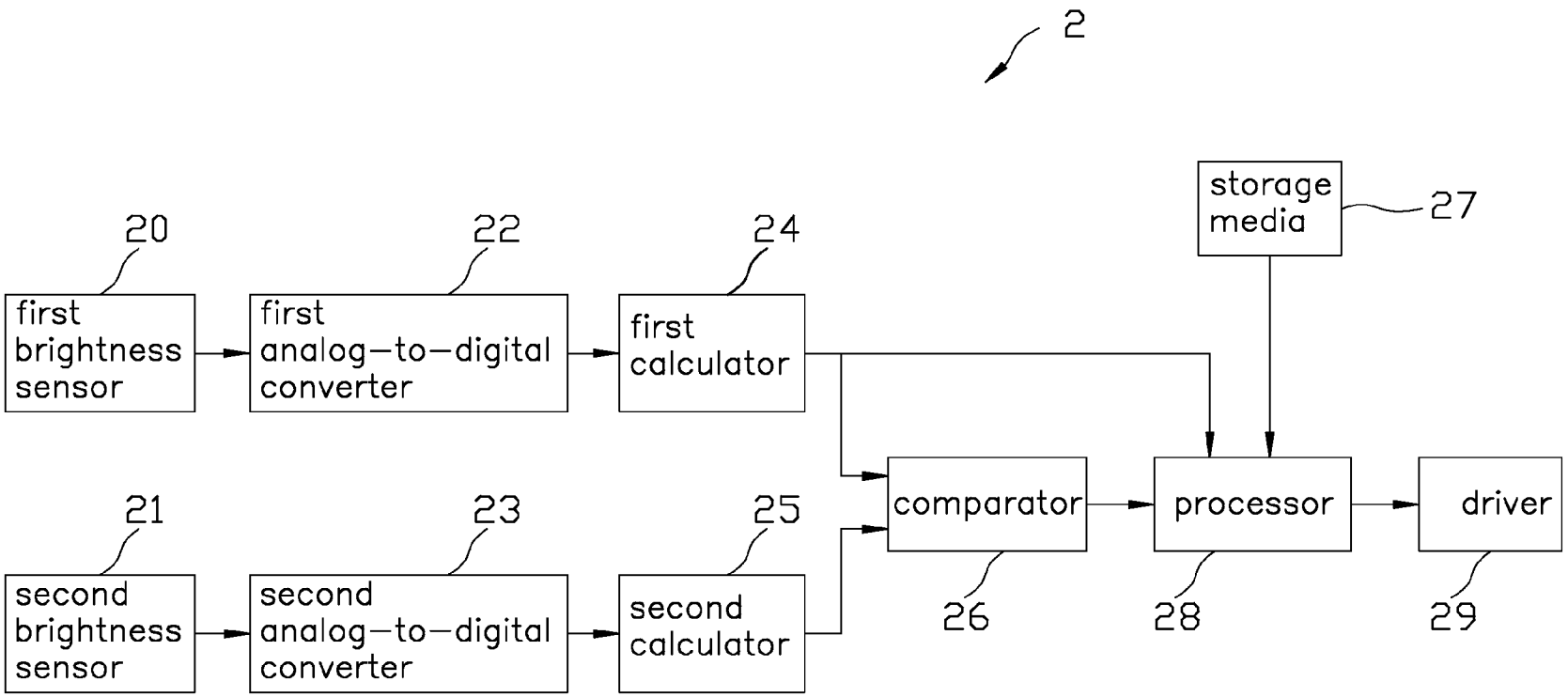
FIG. 2 is a block diagram of the exemplary embodiment of a backlight adjusting system of the present disclosure.

Referring to FIG. 2, the backlight adjusting system 2 includes a first brightness sensor 20, a second brightness sensor 21, a first analog-to-digital converter 22, a second analog-to-digital converter 23, a first calculator 24, a second calculator 25, a comparator 26, a storage media 27, a processor 28 and a driver 29.

The first brightness sensor 20 is configured to detect the ambient brightness of the ambient light and to generate an actual ambient brightness signal accordingly. The first analog-to-digital converter 22 is electrically coupled to the first brightness sensor 20 and configured to convert the actual ambient brightness signal to an actual ambient brightness value of the ambient light in an analog-to-digital manner. The first calculator 24 is electrically coupled to the first analog-to-digital converter and configured to calculate a target display brightness value of the display panel 56 based on the actual ambient brightness value, a predetermined optimal ambient brightness value of the ambient light, and a predetermined optimal display brightness value of the display panel 56 determined according to the predetermined optimal ambient brightness value. In this embodiment, the target display brightness value is calculated by the following formula: the target display brightness value=the actual ambient brightness value×the predetermined optimal display brightness value/the predetermined optimal ambient brightness value, which will be described in more detail later.

In this embodiment, the predetermined optimal ambient brightness value is obtained from a predetermined optimal ambient brightness of the ambient light by the above-mentioned sensing and analog-to-digital conversion. Generally speaking, the optimal ambient brightness is the most visually comfortable ambient brightness for people, and varies according to factors, such as the time of day and human preference, for example. The predetermined optimal display brightness value corresponds to an optimal display brightness of the display panel 56 by which a substantially perfect display quality of the display panel 56 can be obtained under the optimal ambient brightness.

The second brightness sensor 21 is configured to detect the backlight brightness of the light emitting element 58 and to generate an actual backlight brightness signal accordingly. The second analog-to-digital converter 23 is electrically coupled to the second brightness sensor 21 and configured to convert the actual backlight brightness signal to an actual backlight brightness value of the light emitting element 58 in an analog-to-digital manner. The second calculator 25 is electrically coupled to the second analog-to-digital converter 23 and configured to multiply the actual backlight brightness value by a transmittance of the display panel 56 to generate an actual display brightness value of the display panel 56.

In this embodiment, the second brightness sensor 21 may be a photo sensitive element disposed between the display panel 56 and the light emitting element 58, or a thin film transistor formed on the display panel 56. The transmittance used to generate the actual display brightness value corresponds to the maximum grayscale level.

The comparator 26 is electrically coupled to the first calculator 24 and the second calculator 25, and configured to compare the target display brightness value with the actual display brightness value and to generate a comparison result accordingly. The storage media 27 is configured to store a look-up table including a list of predetermined display brightness values and a list of predetermined pulse duty values corresponding respectively to the predetermined display brightness values. The processor 28 is electrically coupled to the first calculator 24, the comparator 26 and the storage media 27 and configured to obtain an initial value of a target pulse duty value from the list of the predetermined pulse duty values by matching the target display brightness value with one of the predetermined display brightness values. The processor 28 then adjusts the initial target pulse duty value to an adjusted target pulse duty value based on the comparison result. The target pulse duty value is increased when the target display brightness value is greater than the actual display brightness value, and is decreased when the target display brightness value is less than the actual display brightness value. The driver 29 is electrically coupled to the processor 28 and configured to generate a driving signal based on the target pulse duty value utilizing pulse width modulation techniques for driving the light emitting element 58 so as to adjust the backlight brightness.

The backlight adjusting system 2 detects the ambient brightness and calculates the target display brightness value through the first brightness sensor 20, the first analog-to-digital converter 22 and the first calculator 24. It detects the backlight brightness and calculates the actual display brightness value through the second brightness sensor 21, the second analog-to-digital converter 23 and the second calculator 25. And it compares the target display brightness value with the display brightness value and adjusts the backlight brightness through the comparator 26, the storage media 27, the processor 28 and the driver 29, so as to adjust the display brightness to the target display brightness value.

In this embodiment, the second brightness sensor 21 is configured to detect the backlight brightness and to generate the actual backlight brightness signal accordingly. In another embodiment, the second brightness sensor 21 may be disposed on a surface of the display panel 56 opposite to the light emitting element 58 and configured to detect the display brightness and to generate an actual display brightness signal accordingly. As such, the second calculator 25 can be omitted, and the second analog-to-digital converter 23 is electrically coupled to the comparator 26 and configured to convert the actual display brightness signal to the actual display brightness value in an analog-to-digital manner.

The following paragraphs describe how the target display brightness value is determined.

Figure 3:
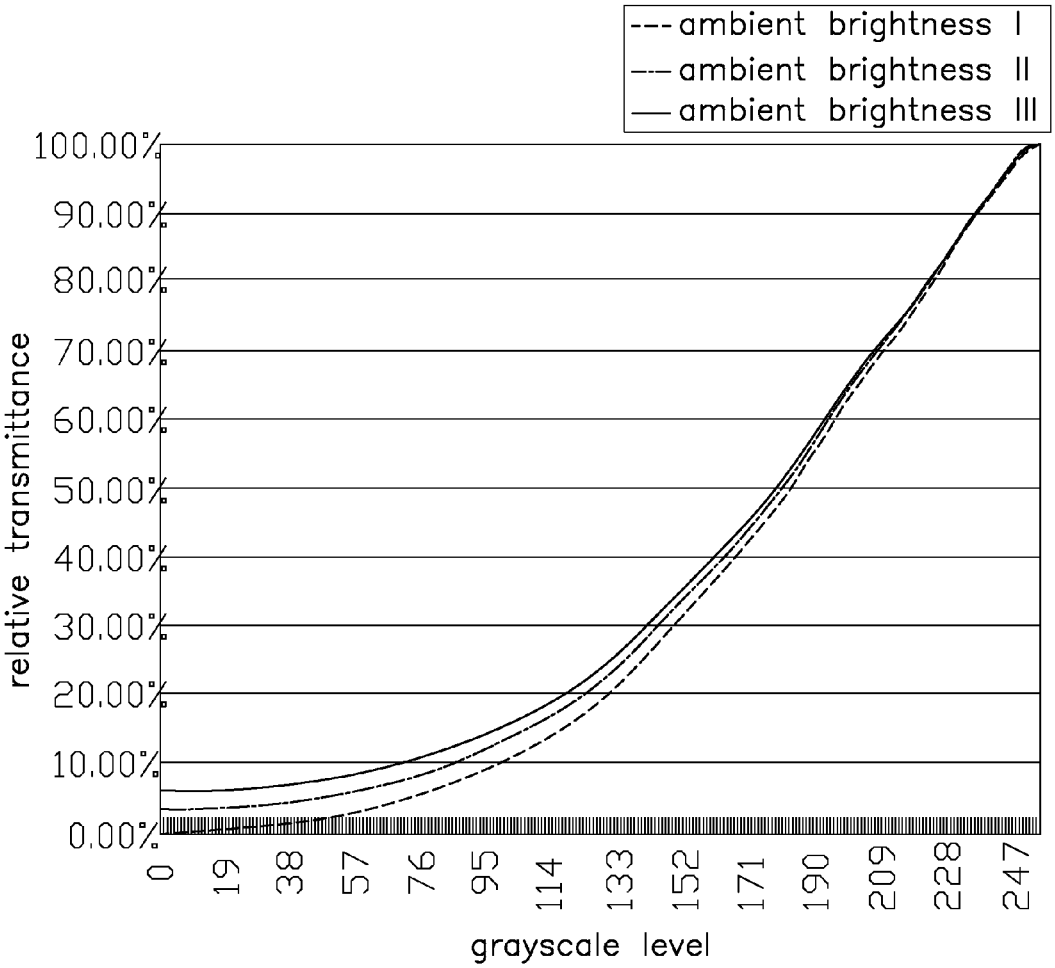
FIG. 3 is a diagram illustrating the relationship between the perceived gamma curve of a display panel and the ambient brightness of an ambient light.

Referring to FIG. 3, the perceived gamma curve of the display panel 56 is different for different ambient brightness levels. Assuming the display brightness and the relative transmittance corresponding to the n-th grayscale level are expressed as $B_n$ and $Y_n$, respectively, then the display brightness and the relative transmittance corresponding to the maximum grayscale level, e.g., the 256-th grayscale level, are $B_{256}$ and 1, respectively, and the relative transmittance corresponding to the n-th grayscale level ($Y_n$) can be expressed as:

$$Y_n = \frac{B_n}{B_{256}} = \left(\frac{n}{256}\right)^{\gamma},$$

where γ is the gamma value of the gamma curve.

When the ambient brightness is $B_y$, assuming the display brightness corresponding to the n-th grayscale level is expressed as $B_{ny}$, then the display brightness corresponding to the maximum grayscale level is $B_{256y}$, and the perceived relative transmittance ($Y'_{n\,By}$) can be expressed as:

$$\begin{aligned} Y'_{nBy} &= \frac{B_{ny} + B_y}{B_{256y} + B_y} \\ &= \frac{B_{ny} + \frac{B_y \cdot B_{ny}}{B_{256y}}}{B_{256y} + B_y} + \frac{B_y \cdot \left(1 - \frac{B_{ny}}{B_{256y}}\right)}{B_{256y} + B_y} \\ &= \frac{B_{ny}}{B_{256y}} + \frac{B_y \cdot \left(1 - \frac{B_{ny}}{B_{256y}}\right)}{B_{256y} + B_y} \\ &= \left(\frac{n}{256}\right)^{\gamma} + \frac{B_y \cdot \left[1 - \left(\frac{n}{256}\right)^{\gamma}\right]}{B_{256y} + B_y}, \end{aligned}$$

and the perceived smoothness of the grayscale shading can be expressed as:

$$\begin{aligned} \frac{Y'_{n+1By} - Y'_{nBy}}{Y'_{nBy}} &= \frac{Y'_{n+1By}}{Y'_{nBy}} - 1 \\ &= \frac{\left(\frac{n+1}{256}\right)^{\gamma} + \frac{B_y \cdot \left[1 - \left(\frac{n+1}{256}\right)^{\gamma}\right]}{B_{256y} + B_y}}{\left(\frac{n}{256}\right)^{\gamma} + \frac{B_y \cdot \left[1 - \left(\frac{n}{256}\right)^{\gamma}\right]}{B_{256y} + B_y}} - 1 \\ &= \frac{B_{256y} \cdot \left(\frac{n+1}{256}\right)^{\gamma} + B_y}{B_{256y} \cdot \left(\frac{n}{256}\right)^{\gamma} + B_y} - 1. \end{aligned}$$

When the optimal ambient brightness is $B_Z$, assuming the display brightness corresponding to the n-th grayscale level is expressed as $B_{nz}$, then the display brightness corresponding to the maximum grayscale level, i.e. the optimal display brightness, is $B_{256z}$, and the perceived smoothness of the grayscale shading can be expressed as:

$$\frac{Y'_{n+1_{Bz}} - Y'_{n_{Bz}}}{Y'_{n_{Bz}}} = \frac{B_{256z}\cdot\left(\frac{n+1}{256}\right)^{\gamma} + B_z}{B_{256z}\cdot\left(\frac{n}{256}\right)^{\gamma} + B_z} - 1.$$

In order to prevent the perceived smoothness of the grayscale shading from varying with the ambient brightness, the following has to be met:

$$\frac{B_{256y}\cdot\left(\frac{n+1}{256}\right)^{\gamma} + B_y}{B_{256y}\cdot\left(\frac{n}{256}\right)^{\gamma} + B_y} - 1 = \frac{B_{256z}\cdot\left(\frac{n+1}{256}\right)^{\gamma} + B_z}{B_{256z}\cdot\left(\frac{n}{256}\right)^{\gamma} + B_z} - 1$$

$$\Rightarrow (B_z\cdot B_{256y} - B_y\cdot B_{256z})\cdot\left(\frac{n}{256}\right)^{\gamma} = (B_z\cdot B_{256y} - B_y\cdot B_{256z})\cdot\left(\frac{n+1}{256}\right)^{\gamma}$$

$$\Rightarrow B_z\cdot B_{256y} = B_y\cdot B_{256z}$$

$$\Rightarrow B_{256y} = \frac{B_y\cdot B_{256z}}{B_z}.$$

From the above, the aforementioned formula for calculating the target display brightness value ($B_{256y}$) is thus derived (the target display brightness value=the actual ambient brightness value×the predetermined optimal display brightness value/the predetermined optimal ambient brightness value).

Figure 4:
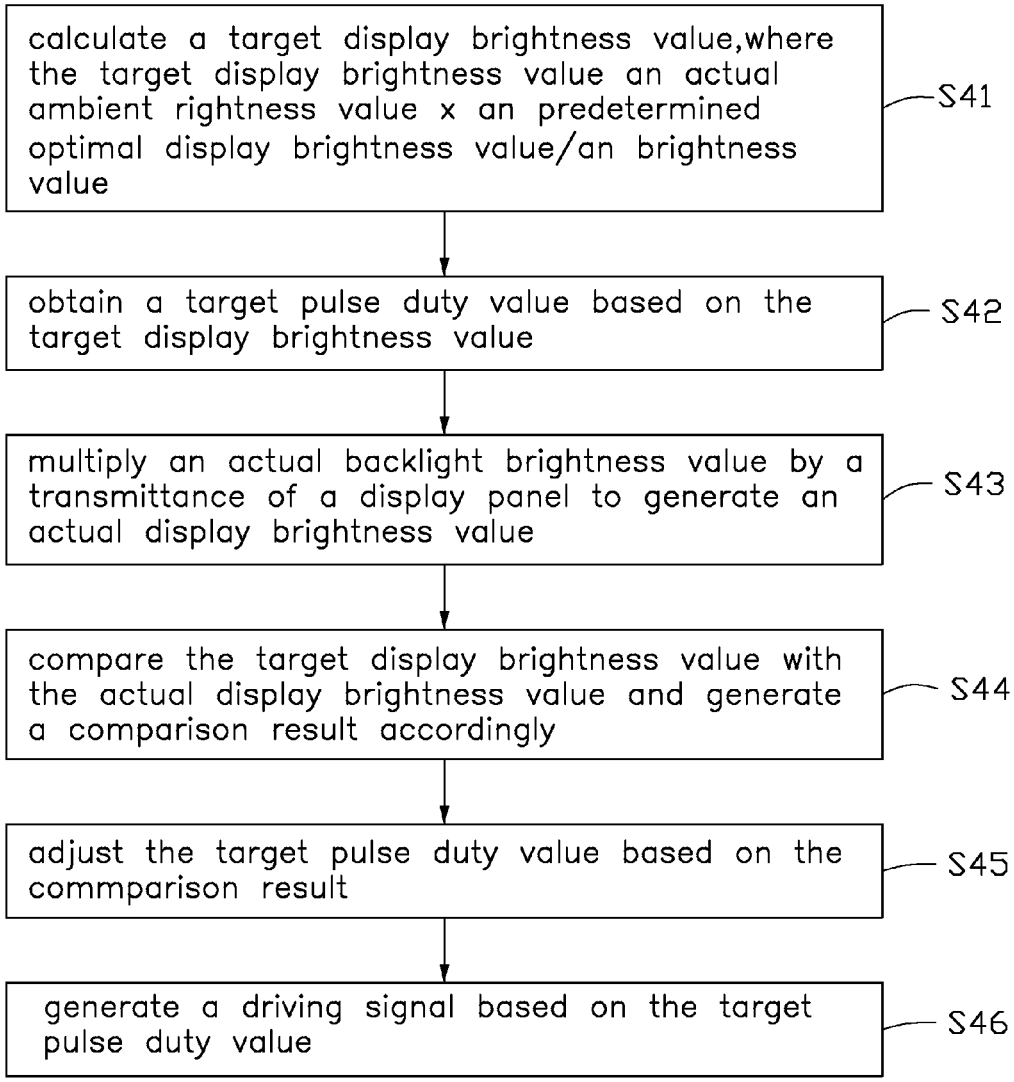
FIG. 4 is a flowchart of one embodiment of a backlight adjusting method implemented in the exemplary embodiment.

Referring to FIGS. 2 and 4, the backlight adjusting method implemented by the backlight adjusting system 2 includes steps shown in FIG. 4.

In step 41, the backlight adjusting system 2 is configured to calculate the target display brightness value based on the actual ambient brightness value, the predetermined optimal ambient brightness value, and the predetermined optimal display brightness value.

In step 42, the backlight adjusting system 2 is configured to obtain the target pulse duty value based on the target display brightness value.

In step 43, the backlight adjusting system 2 is configured to multiply the actual backlight brightness value by the transmittance of the display panel 56 to generate an actual display brightness value.

In step 44, the backlight adjusting system 2 is configured to compare the target display brightness value with the actual display brightness value and to generate the comparison result accordingly.

In step 45, the backlight adjusting system 2 is configured to adjust the target pulse duty value based on the comparison result.

In step 46, the backlight adjusting system 2 is configured to generate the driving signal based on the target pulse duty value utilizing pulse width modulation techniques for driving the light emitting element 58 so as to adjust the backlight brightness.

In sum, according to parameters such as the actual ambient brightness value, the predetermined optimal ambient brightness value and the predetermined optimal display brightness value, the target display brightness value which is related to an optimal backlight brightness of the light emitting element 58 can be calculated. Moreover, the backlight brightness can be adjusted to the optimal backlight brightness based on a comparing result obtained by comparing the target display brightness value and the actual display brightness value. As a consequence, the aforesaid drawback caused by the aging of the light emitting element 58 and by the use of different light emitting elements 58 can be eliminated.

It is to be understood that even though numerous characteristics and advantages of the present embodiments have been set forth in the foregoing description, together with details of the structures and functions of the embodiments, the disclosure is illustrative only; and that changes may be made in detail, especially in matters of shape, size, and arrangement of parts, within the principles of the embodiments, to the full extent indicated by the broad general meaning of the terms in which the appended claims are expressed.

What is claimed is:

1. A backlight adjusting system adapted for adjusting a backlight brightness of a light emitting element for a display panel based on ambient light around the display panel, said backlight adjusting system comprising:

a first calculator configured to calculate a target display brightness value of the display panel based on an actual ambient brightness value of the ambient light, a predetermined optimal ambient brightness value of the ambient light, and a predetermined optimal display brightness value of the display panel determined according to the predetermined optimal ambient brightness value;

a processor electrically coupled to said first calculator and configured to obtain a target pulse duty value based on the target display brightness value; and a driver electrically coupled to said processor and configured to generate a driving signal based on the target pulse duty value utilizing pulse width modulation techniques for driving the light emitting element so as to adjust the backlight brightness of the light emitting element, wherein the target display brightness value=the actual ambient brightness value×the predetermined optimal display brightness value/the predetermined optimal ambient brightness value.

2. The backlight adjusting system of claim 1, further comprising:

a first brightness sensor configured to detect the ambient brightness of the ambient light and to generate an actual ambient brightness signal accordingly; and a first analog-to-digital converter electrically coupled to said first brightness sensor and said first calculator and configured to convert the actual ambient brightness signal to the actual ambient brightness value in an analog-to-digital manner.

3. The backlight adjusting system of claim 1, further comprising:

a comparator electrically coupled to said first calculator and configured to compare the target display brightness value with an actual display brightness value of the display panel and to generate a comparison result accordingly;

wherein said processor is further electrically coupled to said comparator and configured to adjust the target pulse duty value based on the comparison result.

4. The backlight adjusting system of claim 3, wherein said processor is configured to increase the target pulse duty value when the target display brightness value is greater than the actual display brightness value, and to decrease the target pulse duty value when the target display brightness value is less than the actual display brightness value.

5. The backlight adjusting system of claim 3, further comprising:

a second calculator electrically coupled to said comparator and configured to multiply an actual backlight brightness value of the light emitting element by a transmittance of the display panel to generate the actual display brightness value.

6. The backlight adjusting system of claim 5, further comprising:

a second brightness sensor configured to detect the backlight brightness of the light emitting element and to generate an actual backlight brightness signal accordingly; and a second analog-to-digital converter electrically coupled to said second brightness sensor and said second calculator and configured to convert the actual backlight brightness signal to the actual backlight brightness value in an analog-to-digital manner.

7. The backlight adjusting system of claim 3, further comprising:

a second brightness sensor configured to detect the display brightness of the display panel and to generate an actual display brightness signal accordingly; and a second analog-to-digital converter electrically coupled to said second brightness sensor and said comparator and configured to convert the actual display brightness signal to the actual display brightness value in an analog-to-digital manner.

8. The backlight adjusting system of claim 1, further comprising:

a storage media configured to store a list of predetermined display brightness values and a list of predetermined pulse duty values corresponding respectively to the predetermined display brightness values;

wherein said processor is further electrically coupled to said storage media, and is configured to obtain the target pulse duty value from the list of the predetermined pulse duty values by matching the target display brightness value with one of the predetermined display brightness value.

9. A display device, comprising:

a display panel;

a light emitting element optically coupled to the display panel;

the backlight adjusting system of claim 1, for adjusting a backlight brightness of the light emitting element based on an ambient light around the display panel.

10. An electronic device, comprising:

the display device of claim 9; and an input device electrically connected to the display device to input data to the display device to render an image.

11. A backlight adjusting method to be implemented by a system for adjusting a backlight brightness of a light emitting element for a display panel based on an ambient light around the display panel, said backlight adjusting method comprising steps of:

(a) configuring the system to calculate a target display brightness value of the display panel based on an actual ambient brightness value of the ambient light, a predetermined optimal ambient brightness value of the ambient light, and a predetermined optimal display brightness value of the display panel determined according to the predetermined optimal ambient brightness value;

(b) configuring the system to obtain a target pulse duty value based on the target display brightness value; and (c) configuring the system to adjust the backlight brightness of the light emitting element based on the target pulse duty value, wherein the target display brightness value=the actual ambient brightness value×the predetermined optimal display brightness value/the predetermined optimal ambient brightness value.

12. The backlight adjusting method of claim 11, further comprising steps of:

(d) configuring the system to compare the target display brightness value with an actual display brightness value of the display panel and to generate a comparison result accordingly; and (e) configuring the system to adjust the target pulse duty value based on the comparison result.

13. The backlight adjusting method of claim 12, wherein step (e) comprising increasing the target pulse duty value when the target display brightness value is greater than the actual display brightness value, and decreasing the target pulse duty value when the target display brightness value is less than the actual display brightness value.

14. The backlight adjusting method of claim 12, further comprising:

(f) configuring the system to multiply an actual backlight brightness value of the light emitting element by a transmittance of the display panel to generate the actual display brightness value.

15. The backlight adjusting method of claim 10, further comprising;

(g) configuring the system to store a list of predetermined display brightness values and a list of predetermined pulse duty values corresponding respectively to the predetermined display brightness values;

wherein step (b) comprising obtaining the target pulse duty value from the list of the predetermined pulse duty values by matching the target display brightness value with one of the predetermined display brightness value.

16. A backlight adjusting system adapted for adjusting a backlight brightness of a light emitting element for a display panel based on an ambient light around the display panel, said backlight adjusting system, the backlight adjusting system comprising:

a first brightness sensor configured to detect the ambient brightness of the ambient light and to generate an actual ambient brightness signal accordingly;

a first analog-to-digital converter electrically coupled to said first brightness sensor and configured to convert the actual ambient brightness signal to an actual ambient brightness value in an analog-to-digital manner;

a first calculator electrically coupled to said first analog-to-digital converter and configured to calculate a target display brightness value of the display panel based on the actual ambient brightness value, a predetermined optimal ambient brightness value of the ambient light, and a predetermined optimal display brightness value of the display panel determined according to the predetermined optimal ambient brightness value;

a comparator electrically coupled to said first calculator and configured to compare the target display brightness value with an actual display brightness value of the display panel and to generate a comparison result accordingly;

a processor electrically coupled to said comparator and configured to adjust a target pulse duty value based on the comparison result; and a driver electrically coupled to said processor and configured to generate a driving signal based on the target pulse duty value utilizing pulse width modulation techniques for driving the light emitting element so as to adjust the backlight brightness of the light emitting element.

17. The backlight adjusting system of claim 16, wherein the target display brightness value=the actual ambient brightness value×the predetermined optimal display brightness value/the predetermined optimal ambient brightness value.

18. The backlight adjusting system of claim 16, further comprising:

a second calculator electrically coupled to said comparator and configured to multiply an actual backlight brightness value of the light emitting element by a transmittance of the display panel to generate the actual display brightness value.

19. The backlight adjusting system of claim 18, further comprising:

a second brightness sensor configured to detect the backlight brightness of the light emitting element and to generate an actual backlight brightness signal accordingly; and a second analog-to-digital converter electrically coupled to said second brightness sensor and said second calculator and configured to convert the actual backlight brightness signal to the actual backlight brightness value in an analog-to-digital manner.

20. The backlight adjusting system of claim 16, further comprising:

a second brightness sensor configured to detect the display brightness of the display panel and to generate an actual display brightness signal accordingly; and a second analog-to-digital converter electrically coupled to said second brightness sensor and said comparator and configured to convert the actual display brightness signal to the actual display brightness value in an analog-to-digital manner.

21. The backlight adjusting system of claim 16, further comprising:

a storage media configured to store a list of predetermined display brightness values and a list of predetermined pulse duty values corresponding respectively to the predetermined display brightness values;

wherein said processor is further electrically coupled to said storage media and configured to obtain the target pulse duty value from the list of the predetermined pulse duty values by matching the target display brightness value with one of the predetermined display brightness value.

* * * * *